US008002525B2

(12) United States Patent
Whalley

(10) Patent No.: US 8,002,525 B2
(45) Date of Patent: Aug. 23, 2011

(54) TURBINE AIRFOIL COOLING SYSTEM WITH RECESSED TRAILING EDGE COOLING SLOT

(75) Inventor: Andrew Whalley, Jupiter, FL (US)

(73) Assignee: Siemens Energy, Inc., Orlando, FL (US)

( * ) Notice: Subject to any disclaimer, the term of this patent is extended or adjusted under 35 U.S.C. 154(b) by 949 days.

(21) Appl. No.: 11/941,162

(22) Filed: Nov. 16, 2007

(65) Prior Publication Data

US 2009/0129915 A1 May 21, 2009

(51) Int. Cl.
*F01D 5/08* (2006.01)

(52) U.S. Cl. ..... 416/97 R; 415/115

(58) Field of Classification Search ..... 415/115; 416/95, 96 R, 96 A, 97 A, 97 R
See application file for complete search history.

(56) References Cited

U.S. PATENT DOCUMENTS

| | | | | |
|---|---|---|---|---|
| 4,303,374 | A * | 12/1981 | Braddy | 416/97 R |
| 4,601,638 | A | 7/1986 | Hill et al. | |
| 5,503,529 | A * | 4/1996 | Anselmi et al. | 416/97 R |
| 6,004,100 | A * | 12/1999 | Przirembel et al. | 416/97 R |
| 6,174,135 | B1 | 1/2001 | Lee | |
| 6,328,531 | B1 * | 12/2001 | Bariaud et al. | 416/97 R |
| 6,514,042 | B2 * | 2/2003 | Kvasnak et al. | 416/97 R |
| 6,709,237 | B2 * | 3/2004 | Tiemann | 416/97 R |
| 6,830,431 | B2 * | 12/2004 | Bariaud et al. | 416/97 R |
| 7,118,337 | B2 * | 10/2006 | Liang | 416/1 |
| 2006/0222496 | A1 | 10/2006 | Lee et al. | |
| 2006/0269419 | A1 | 11/2006 | Downs et al. | |
| 2007/0128036 | A1 | 6/2007 | Boury et al. | |

FOREIGN PATENT DOCUMENTS

| | | | |
|---|---|---|---|
| JP | 2001271603 | A | 10/2001 |
| KR | 3055545 | A | 7/2003 |

* cited by examiner

*Primary Examiner* — Igor Kershteyn

(57) ABSTRACT

A cooling system for a turbine airfoil of a turbine engine having a trailing edge cooling slot positioned within the generally elongated, hollow airfoil and extending from the trailing edge chordwise into the generally elongated, hollow airfoil toward the leading edge such that a secondary trailing edge is offset upstream from the trailing edge. As such, the trailing edge cooling slot reduces stress formation at the trailing edge of the turbine airfoil.

20 Claims, 3 Drawing Sheets

TURBINE AIRFOIL COOLING SYSTEM WITH RECESSED TRAILING EDGE COOLING SLOT

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Typically, the trailing edge of turbine airfoils develop hot spots. Trailing edges are thus often designed to be thin and include cooling channels that exhaust cooling fluids from the pressure side of the trailing edge. This design minimizes the trailing edge thickness but creates shear mixing between the cooling air and the mainstream flow as the cooling air exits from the pressure side. The shear mixing of the cooling fluids with the mainstream flow reduces the cooling effectiveness of the trailing edge overhang and thus, induces over temperature at the airfoil trailing edge suction side location. Frequently, the hot spot developed in the trailing edge becomes the life limiting location for the entire airfoil. Thus, a need exists for a cooling system capable of providing sufficient cooling to trailing edge of turbine airfoils.

SUMMARY OF THE INVENTION

This invention relates to a turbine airfoil cooling system for a turbine airfoil used in turbine engines. In particular, the turbine airfoil cooling system may include one or more internal cavities positioned between outer walls of a generally elongated, hollow airfoil of the turbine airfoil. The cooling system may include one or more trailing edge cooling slots positioned in the generally elongated, hollow airfoil. The trailing edge cooling slot may be positioned in a trailing edge and extend from the trailing edge chordwise into the generally elongated, hollow airfoil toward a leading edge such that a secondary trailing edge is formed and is offset upstream from the trailing edge. The trailing edge cooling slots may also extend into the fillet at the intersection of the platform and airfoil. Such a configuration reduces the temperature of the trailing edge during operating conditions.

The turbine airfoil may include a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil. The turbine airfoil may include at least one trailing edge cooling slot positioned within the generally elongated, hollow airfoil and extending from the trailing edge chordwise into the generally elongated, hollow airfoil toward the leading edge such that a secondary trailing edge is offset upstream from the trailing edge. The at least one trailing edge cooling slot may extend from close proximity to the tip section of the generally elongated, hollow airfoil to terminate within close proximity of the root. In one embodiment, the at least one trailing edge cooling slot may extend into a fillet at an intersection between a platform at the root and the generally elongated, hollow airfoil. The at least one trailing edge cooling slot may extend into the generally elongated, hollow airfoil a distance equal to about less than ten times an exhaust orifice diameter.

The at least one trailing edge cooling slot may include inboard and outboard side surfaces that are generally aligned with an outer wall at the tip section and with each other. The exhaust orifices may be separated from each other no more than a distance equal to about three times a width of an exhaust orifice to facilitate mixing of discharged cooling fluids. The at least one trailing edge cooling slot may include inboard and outboard side surfaces that are curved toward each other. In another embodiment, the at least one trailing edge cooling slot includes inboard and outboard side surfaces that are linear and angled toward each other.

A plurality of exhaust orifices may be positioned in the secondary trailing edge and in communication with other components of the cooling system for exhausting cooling fluids from the cooling system. A plurality of ribs may extend from the secondary trailing edge axially toward the trailing edge and terminating before reaching the trailing edge, wherein the ribs are tapered and have ever reducing cross-sectional area moving toward the trailing edge and wherein the ribs form diffusers.

An advantage of this invention is that the trailing edge cooling slot offsets the exhaust orifices upstream from the trailing edge, thereby placing the exhaust orifices at a location where the metal temperature is lower and thermally induced stresses are lower.

Another advantage of this invention is that the trailing edge cooling slot leads to increased airfoil life and a reduced risk of crack formation.

Yet another advantage of this invention is that by offsetting the exhaust orifices upstream from the trailing edge in the trailing edge cooling slot, stresses may be reduced by placing the exhaust orifices closer in a shroud than conventional configurations, thereby increasing the life of the airfoil and reducing the risk of crack formation.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 2:
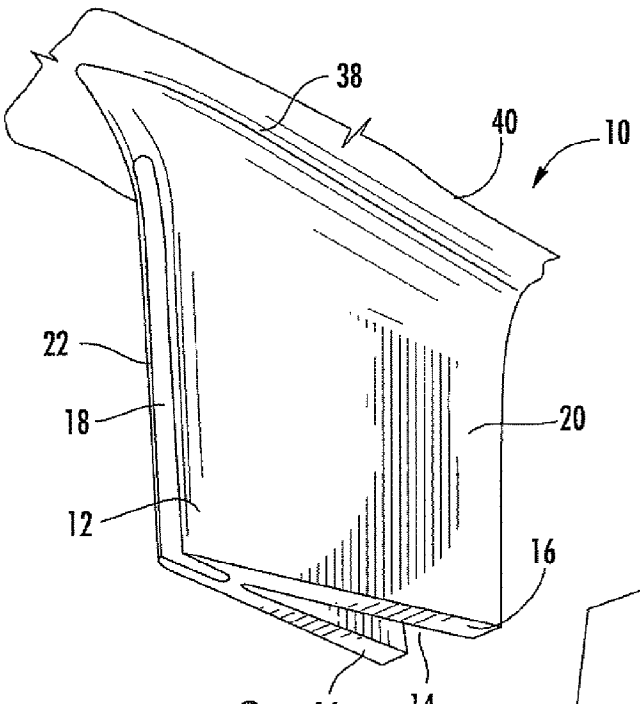
FIG. 2 is a partial perspective view of the trailing edge of the turbine airfoil of claim 1 taken along line 2-2 in FIG. 1.

As shown in FIGS. 1-8, this invention is directed to a turbine airfoil cooling system 10 for a turbine airfoil 12 used in turbine engines. In particular, the turbine airfoil cooling system 10 may include one or more internal cavities 14, as shown in FIG. 2, positioned between outer walls 16 of a generally elongated, hollow airfoil 20 of the turbine airfoil 12. The cooling system 10 may include one or more trailing edge cooling slots 18 positioned in the generally elongated, hollow airfoil 20. The trailing edge cooling slots 18 may be positioned in a trailing edge 22 and extend from the trailing edge 22 chordwise into the generally elongated, hollow airfoil 20 toward a leading edge 24 such that a secondary trailing edge 26 is formed and is offset upstream from the trailing edge 22. Such a configuration reduces the temperature of the trailing edge 22 during operating conditions, thereby reducing stresses on the trailing edge 22.

The turbine airfoil 12 may be formed from the generally elongated, hollow airfoil 20 formed by an outer wall 16 and having the leading edge 24, the trailing edge 22 opposite to the leading edge 24, a tip section 28 at a first end 30, a root 32 coupled to the airfoil 12 at an end generally opposite the first end 30 for supporting the airfoil 12 and for coupling the airfoil 12 to a disc, and a cooling system 10 formed from at least one cavity 14 in the elongated, hollow airfoil 20 positioned in internal aspects of the generally elongated, hollow airfoil 20. The turbine airfoil 12 may be a turbine vane or turbine blade, or other appropriate airfoil. The cooling system 10 is not limited to any particular configuration but may have any appropriate configuration.

Figure 5:
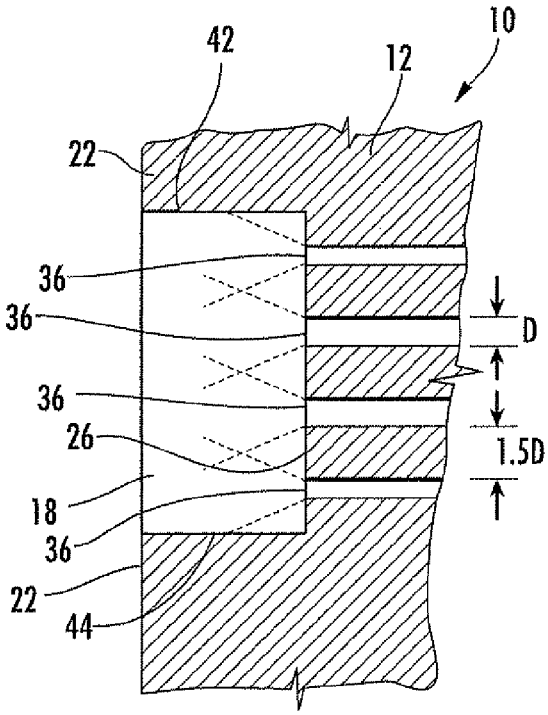
FIG. 5 is a partial cross-sectional view of an alternative configuration of the trailing edge cooling slot.
Figure 7:
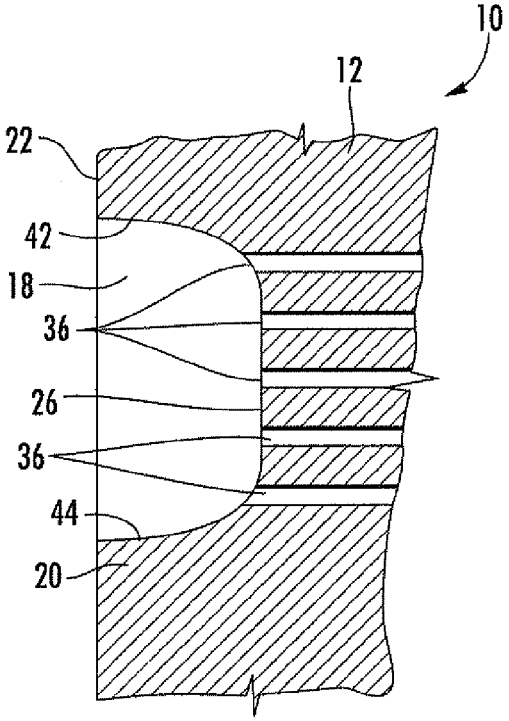
FIG. 7 is a partial cross-sectional view of yet another alternative configuration of the trailing edge cooling slot.
Figure 8:
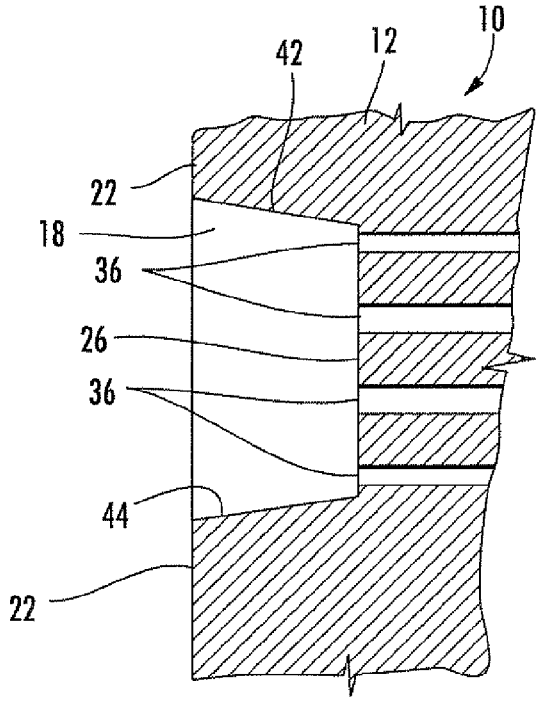
FIG. 8 is a partial cross-sectional view of yet another alternative configuration of the trailing edge cooling slot.

The trailing edge cooling slot 18 may be positioned in the trailing edge 22. The trailing edge cooling slots 18 may have different configurations, as shown in FIGS. 5-8. As shown in FIG. 5, the trailing edge cooling slot 18 may have inboard and outboard side surfaces 42, 44 that may be aligned with the outer wall 16 at the tip section 28 and with each other. The inboard and outboard side surfaces 42, 44 may extend from a pressure side 48 to a suction side 50 of the airfoil 20. The trailing edge cooling slot 18 may extend from close proximity to the tip section 28 of the generally elongated, hollow airfoil 20 to terminate within close proximity of the root 32 or have any other appropriate length. As shown in FIG. 7, the trailing edge cooling slot 18 may include inboard and outboard side surfaces 42, 44 that are curved toward each other. The inboard and outboard side surfaces 42, 44 shown in FIG. 7 may be circular, oval, elliptical, or other curvilinear shape. As shown in FIG. 8, the trailing edge cooling slot 18 may include inboard and outboard side surfaces 42, 44 that are linear and angled toward each other such that the secondary trailing edge 26 is shorter than the opening of the trailing edge cooling slot 18 at the trailing edge 22.

Figure 1:
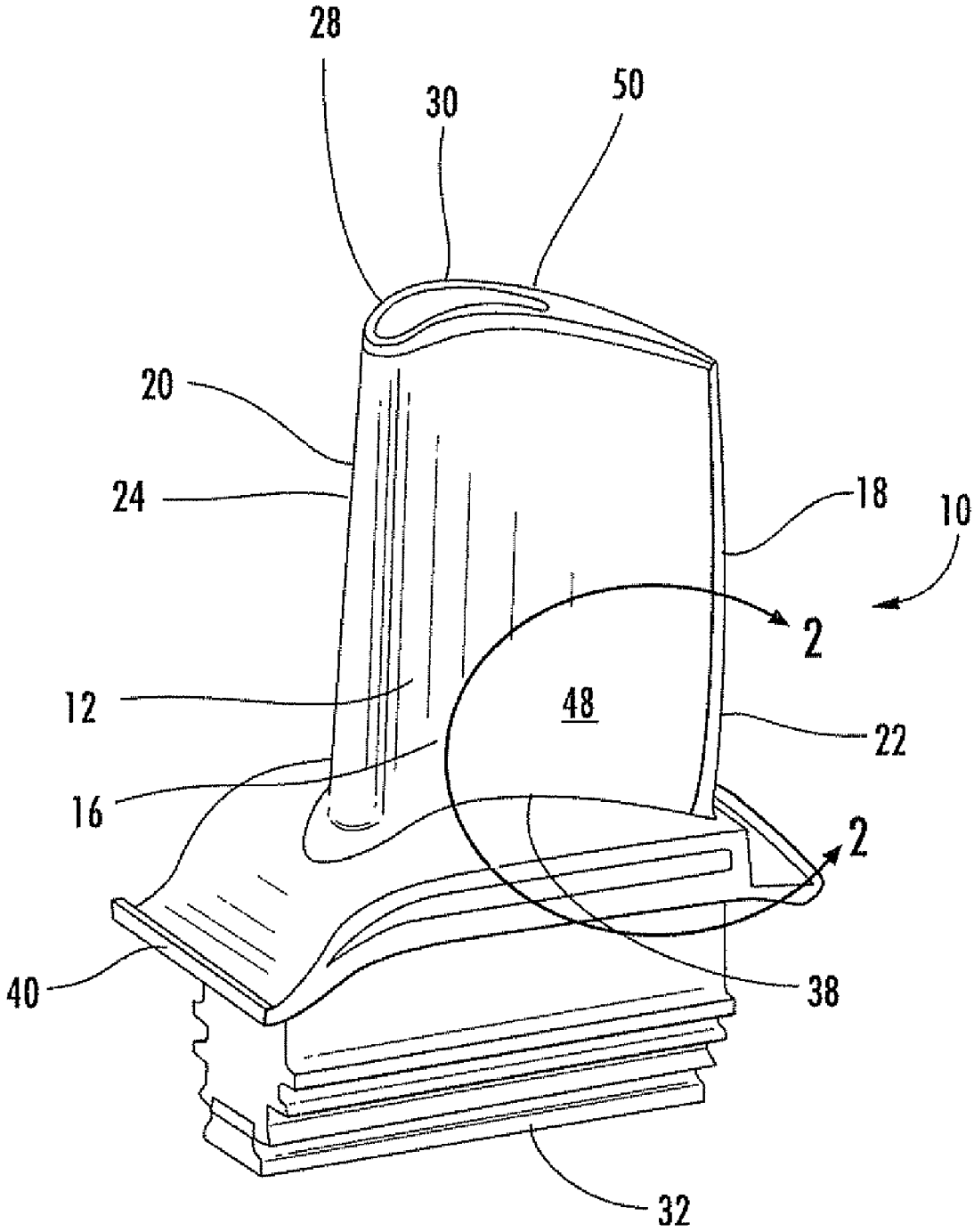
FIG. 1 is a perspective view of a turbine airfoil having features according to the instant invention.
Figure 3:
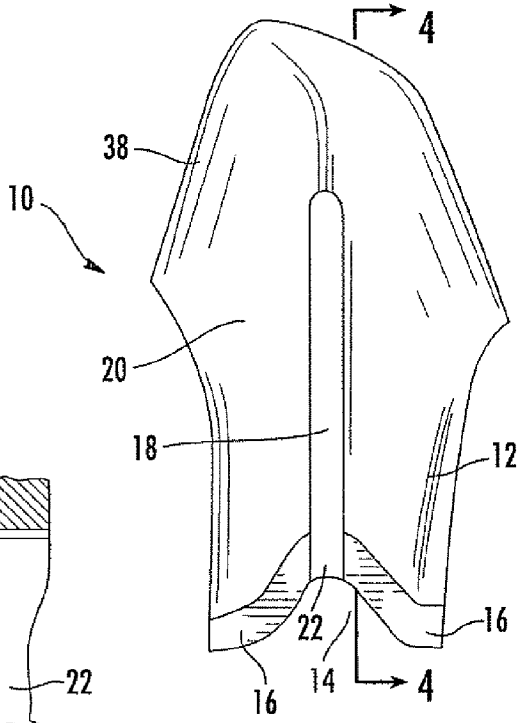
FIG. 3 is another partial perspective view of the trailing edge of the turbine airfoil of claim 1.
Figure 4:
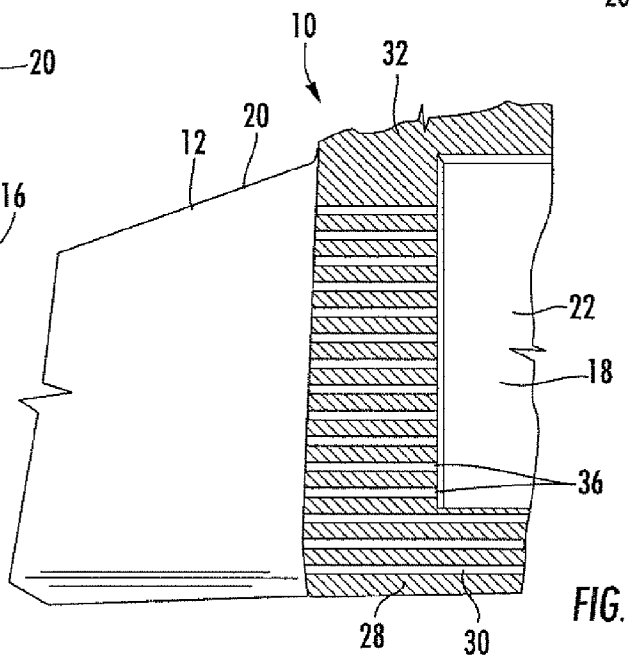
FIG. 4 is a cross-sectional view of the trailing edge of the turbine airfoil taken along section line 4-4 in FIG. 3.

As shown in FIGS. 2 and 3, the trailing edge cooling slot 18 may extend into a fillet 38 at an intersection between a platform 40 at the root 32 and the generally elongated, hollow airfoil 20 to provide cooling fluids to the fillet, 38 which is often difficult to cool. In one embodiment, the trailing edge cooling slot 18 may extend chordwise into the generally elongated, hollow airfoil 20 a distance equal to about less than ten times an exhaust orifice 36 diameter.

A plurality of exhaust orifices 36 may be positioned in the secondary trailing edge 26 and in communication with other components of the cooling system 10 for exhausting cooling fluids from the cooling system 10. The exhaust orifices 36 may have any appropriate cross-sectional configuration, such as, but not limited to circular, oval, elliptical or other appropriate shape. The exhaust orifices 36 may be separated from each other no more than a distance equal to about three times a width of an exhaust orifice 36. Such a configuration ensures sufficient mixing of cooling fluids flowing from the exhaust orifices 36. As shown in FIGS. 7 and 8, the exhaust orifices 36 may terminate in portions of the secondary trailing edge 26 that are generally aligned with the trailing edge 22.

Figure 6:
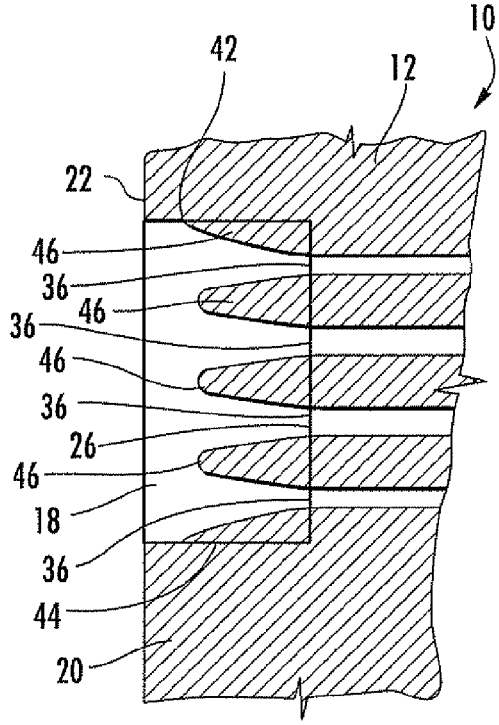
FIG. 6 is a partial cross-sectional view of another alternative configuration of the trailing edge cooling slot.

The turbine airfoil 12 may also include ribs 46, as shown in FIG. 6, that form diffusers extending from the secondary trailing edge 26 chordwise toward the trailing edge 22. The ribs 46 may terminate before reaching the trailing edge 22. The ribs 46 may be tapered and may have ever reducing cross-sectional areas moving toward the trailing edge 22. The ends of the ribs 46 may be rounded. The ribs 46 may extend about half way into the trailing edge cooling slot 18 from the secondary trailing edge 26. In other embodiments, the ribs 46 may have other lengths.

During use, cooling fluids may flow into the cooling system 10 from a cooling fluid supply source. A portion of the cooling fluids may flow through the trailing edge exhaust orifices 36 and into the trailing edge cooling slot 18. The cooling fluids may diffuse and mix in the trailing edge cooling slot 18. The cooling fluids may then flow from the trailing edge cooling slot 18 and be discharged from the turbine airfoil 12.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil;

at least one trailing edge cooling slot positioned within the generally elongated, hollow airfoil and extending from the trailing edge chordwise into the generally elongated, hollow airfoil toward the leading edge such that a secondary trailing edge is offset upstream from the trailing edge, wherein the at least one trailing edge slot is defined by a pressure side wall and an opposite suction side wall that each define a portion of the generally elongated, hollow airfoil such that a downstream opening of the at least one trailing edge cooling slot is positioned in the trailing edge of the airfoil; and wherein the cooling system includes a plurality of exhaust orifices positioned in the secondary trailing edge for exhausting cooling fluids from the cooling system.

2. The turbine airfoil of claim 1, wherein the at least one trailing edge cooling slot extends from close proximity to the tip section of the generally elongated, hollow airfoil to terminate within close proximity of the root.

3. The turbine airfoil of claim 1, wherein the at least one trailing edge cooling slot extends into a fillet at an intersection between a platform at the root and the generally elongated, hollow airfoil.

4. The turbine airfoil of claim 1, wherein the at least one trailing edge cooling slot extends into the generally elongated, hollow airfoil a distance equal to about less than ten times an exhaust orifice diameter.

5. The turbine airfoil of claim 1, wherein the at least one trailing edge cooling slot includes inboard and outboard side surfaces that are generally aligned with an outer wall at the tip section and with each other.

6. The turbine airfoil of claim 5, wherein the exhaust orifices are separated from each other no more than a distance equal to about three times a width of an exhaust orifice.

7. The turbine airfoil of claim 1, wherein the at least one trailing edge cooling slot includes inboard and outboard side surfaces that are curved toward each other.

8. The turbine airfoil of claim 1, wherein the at least one trailing edge cooling slot includes inboard and outboard side surfaces that are linear and angled toward each other.

9. The turbine airfoil of claim 1, further comprising ribs extending from the secondary trailing edge axially toward the trailing edge and terminating before reaching the trailing edge, wherein the ribs are tapered and have ever reducing cross-sectional area moving toward the trailing edge and wherein the ribs form diffusers.

10. A turbine airfoil, comprising:

a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil;

at least one trailing edge cooling slot positioned within the generally elongated, hollow airfoil and extending from the trailing edge chordwise into the generally elongated, hollow airfoil toward the leading edge such that a secondary trailing edge is offset upstream from the trailing edge, wherein the at least one trailing edge slot is defined by a pressure side wall and an opposite suction side wall that each define a portion of the generally elongated, hollow airfoil such that a downstream opening of the at least one trailing edge cooling slot is positioned in the trailing edge of the airfoil;

wherein the cooling system includes a plurality of exhaust orifices positioned in the secondary trailing edge for exhausting cooling fluids from the cooling system; and wherein the at least one trailing edge cooling slot extends into a fillet at an intersection between a platform at the root and the generally elongated, hollow airfoil.

11. The turbine airfoil of claim 10, wherein the at least one trailing edge cooling slot extends from close proximity to the tip section of the generally elongated, hollow airfoil to terminate in the fillet at the root.

12. The turbine airfoil of claim 10, wherein the at least one trailing edge cooling slot extends into the generally elongated, hollow airfoil a distance equal to about less than ten times an exhaust orifice diameter.

13. The turbine airfoil of claim 10, wherein the at least one trailing edge cooling slot includes inboard and outboard side surfaces that are generally aligned with an outer wall at the tip section and with each other.

14. The turbine airfoil of claim 13, wherein the exhaust orifices are separated from each other no more than a distance equal to about three times a width of an exhaust orifice.

15. The turbine airfoil of claim 10, wherein the at least one trailing edge cooling slot includes inboard and outboard side surfaces that are curved toward each other.

16. The turbine airfoil of claim 10, wherein the at least one trailing edge cooling slot includes inboard and outboard side surfaces that are linear and angled toward each other.

17. The turbine airfoil of claim 10, further comprising ribs extending from the secondary trailing edge axially toward the trailing edge and terminating before reaching the trailing edge, wherein the ribs are tapered and have ever reducing cross-sectional area moving toward the trailing edge and wherein the ribs form diffusers.

18. A turbine airfoil, comprising:

a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil;

at least one trailing edge cooling slot positioned within the generally elongated, hollow airfoil and extending from the trailing edge chordwise into the generally elongated, hollow airfoil toward the leading edge such that a secondary trailing edge is offset upstream from the trailing edge, wherein the at least one trailing edge slot is defined by a pressure side wall and an opposite suction side wall that each define a portion of the generally elongated, hollow airfoil such that a downstream opening of the at least one trailing edge cooling slot is positioned in the trailing edge of the airfoil;

wherein the cooling system includes a plurality of exhaust orifices positioned in the secondary trailing edge for exhausting cooling fluids from the cooling system; and wherein the exhaust orifices are separated from each other no more than a distance equal to about three times a width of an exhaust orifice.

19. The turbine airfoil of claim 18, wherein the at least one trailing edge cooling slot extends from close proximity to the tip section of the generally elongated, hollow airfoil to terminate in a fillet at an intersection between a platform at the root and the generally elongated, hollow airfoil.

20. The turbine airfoil of claim 18, wherein the at least one trailing edge cooling slot includes inboard and outboard side surfaces that are generally aligned with an outer wall at the tip section and with each other and further comprising ribs extending from the secondary trailing edge axially toward the trailing edge and terminating before reaching the trailing edge, wherein the ribs are tapered and have ever reducing cross-sectional area moving toward the trailing edge and wherein the ribs form diffusers.

* * * * *